US008020697B2

(12) United States Patent
Chatelain et al.

(10) Patent No.: US 8,020,697 B2
(45) Date of Patent: Sep. 20, 2011

(54) HINGE-LID CONTAINER WITH ADDITIONAL INTEGRAL PANELS

(75) Inventors: Lucas Chatelain, Savigny (CH); Jacques Weiss, Vufflens-la-Ville (CH)

(73) Assignee: Philip Morris USA Inc., Richmond, VA (US)

( * ) Notice: Subject to any disclaimer, the term of this patent is extended or adjusted under 35 U.S.C. 154(b) by 840 days.

(21) Appl. No.: 11/725,509

(22) Filed: Mar. 20, 2007

(65) Prior Publication Data

US 2007/0221518 A1 Sep. 27, 2007

(30) Foreign Application Priority Data

Mar. 20, 2006 (EP) ..... 06251477

(51) Int. Cl.
*B65D 85/10* (2006.01)
*B65D 85/00* (2006.01)

(52) U.S. Cl. ..... 206/273; 206/268; 229/122

(58) Field of Classification Search ..... 206/273, 206/268, 831, 459.5, 242, 774, 232, 261, 206/264, 271, 265; 229/118, 122, 123.3, 229/123.2, 141, 147–149
See application file for complete search history.

(56) References Cited

U.S. PATENT DOCUMENTS

| | | | | | |
|---|---|---|---|---|---|
| 2,331,754 | A | * | 10/1943 | Wohlers | 229/148 |
| 3,099,381 | A | * | 7/1963 | Meyers | 206/459.5 |
| 3,156,351 | A | * | 11/1964 | Small | 206/317 |
| 3,896,987 | A | * | 7/1975 | Soja | 206/315.11 |
| 4,108,350 | A | * | 8/1978 | Forbes, Jr. | 229/132 |
| 4,265,393 | A | * | 5/1981 | Orchard | 229/103.3 |
| 5,038,930 | A | * | 8/1991 | Holtkamp, Jr. | 206/232 |
| 5,407,076 | A | * | 4/1995 | Sabet | 206/581 |
| 5,458,235 | A | * | 10/1995 | Stone | 206/232 |
| D390,108 | S | * | 2/1998 | Landis et al. | D9/415 |
| 6,068,115 | A | * | 5/2000 | Boulton | 206/232 |
| 6,394,273 | B1 | * | 5/2002 | Dixon | 206/459.5 |
| 6,467,614 | B1 | * | 10/2002 | Tallier et al. | 206/264 |
| 6,695,144 | B2 | * | 2/2004 | Freeze | 206/768 |
| 6,786,331 | B1 | * | 9/2004 | Zucchini | 206/232 |
| 2009/0188817 | A1 | * | 7/2009 | Margolis | 206/237 |

FOREIGN PATENT DOCUMENTS

| | | |
|---|---|---|
| DE | 198 14 255 A1 | 10/1999 |
| DE | 202 08 513 UA | 11/2002 |
| WO | WO 2005/105588 A1 | 11/2005 |

* cited by examiner

OTHER PUBLICATIONS

International Preliminary Report on Patentability dated Sep. 23, 2008 for PCT/IB2007/001748. International Search Report and Written Opinion dated Sep. 5, 2007 for PCT/IB2007/001748.

*Primary Examiner* — Steven A. Reynolds
(74) *Attorney, Agent, or Firm* — Buchanan Ingersoll & Rooney PC

(57) ABSTRACT

A hinge-lid container includes a box portion and a lid portion hinged to the box portion. The box portion includes an integral first panel connected to the remainder of the container along a first hinge line and an integral second panel. The first panel in an initial position forms at least part of a wall of the box portion and the second panel in an initial position underlies the first panel. The first panel is defined in the wall of the box portion by at least one line of weakness in the initial position and is foldable about the first hinge line from the initial position to a second position in which it is hinged outwardly from the remainder of the container. The second panel is connected to the remainder of the container along a second hinge line. The box portion can include an integral third panel.

17 Claims, 9 Drawing Sheets

HINGE-LID CONTAINER WITH ADDITIONAL INTEGRAL PANELS

This application claims priority under 35 U.S.C. §119 to European Application No. 06251477.3, filed Mar. 20, 2006, the entire content of which is hereby incorporated by reference.

FIELD OF THE INVENTION

The present invention relates to a novel hinge-lid container and in particular to a novel hinge-lid pack or carton for consumer goods.

BACKGROUND

It is known to package a variety of consumer goods in hinge-lid containers that comprise a receptacle portion for housing the goods and a reclosable lid that is hinged to the receptacle portion. For example, cigarettes and other smoking articles are commonly sold in hinge-lid packs comprising a lower box portion and an upper lid portion, which is hinged to the rear wall of the lower box portion. Such packs are formed from laminar cardboard blanks that include various panels and flaps, which when folded about appropriate score lines around a pre-wrapped bundle of cigarettes form the box portion and the lid portion of the hinge-lid pack.

Graphics and text are typically applied to the exterior of packaging for consumer goods in order to communicate information to the consumer. It would be desirable to provide hinge-lid containers for consumer goods having substantially the same external appearance as conventional hinge-lid containers, but with additional surface areas that may, for example, carry supplementary brand, advertising, promotional or product information.

Conventional hinge-lid cigarette packs are relatively small in size and so have especially limited visible exterior surface area. It would be particularly desirable, therefore, to provide a hinge-lid pack for smoking articles having substantially the same external appearance as a conventional hinge-lid cigarette pack, but comprising additional surface areas.

It would further be desirable to provide a hinge-lid container having such additional surface areas, which can be produced with minimal or no modification to existing packing machinery.

DE-A-198 14 255 discloses a hinge-lid cardboard cigarette pack having a pair of additional flaps extending from the longitudinal rear edges of the outer side wall panels of the box portion, which are folded against the rear wall of the box portion.

SUMMARY

According to the present invention there is provided a hinge-lid container comprising: a box portion; and a lid portion hinged to the box portion, the box portion including: an integral first panel connected to the remainder of the container along a first hinge line; and an integral second panel, the first panel in an initial position forming part at least part of a wall of the box portion and the second panel in an initial position underlying the first panel, the first panel being defined in the wall of the box portion by at least one line of weakness in the initial position and being foldable about the first hinge line from the initial position to a second position in which it is hinged outwardly from the remainder of the container.

By moving the first panel from the initial position to the second position, the consumer exposes the inwardly facing surface of the first panel and the outwardly facing surface of the second panel, which face one another when the first panel and the second panel are in their initial positions. The inwardly facing surface of the first panel and the outwardly facing surface of the second panel of the box portion of hinge-lid containers according to the present invention thus advantageously provide additional surface areas on which consumer information may be printed, embossed or otherwise displayed.

Preferably, the second panel is connected to the remainder of the container along a second hinge line. Preferably, the second panel is foldable about the second hinge line from the initial position to a second position in which it is hinged outwardly from the remainder of the container.

In use, having folded the integral first panel about the first hinge line from the initial position to the second position, thereby revealing the second panel, the consumer may fold the second panel about the second hinge line to the second position, wherein the second panel is hinged outwardly from the remainder of the container.

By moving the second panel from the initial position to the second position, the consumer further exposes the inwardly facing surface of the second panel, which thereby advantageously also provides an additional surface area on which consumer information may be printed, embossed or otherwise displayed.

Preferably, the box portion further includes an integral third panel that in an initial position underlies the second panel. In use, by folding the second panel about the second hinge line to the second position, wherein the second panel is hinged outwardly from the remainder of the container, the consumer reveals or uncovers the third panel, which in an initial position underlies the second panel inwardly thereof. The outwardly facing surface of the third panel, which faces the inwardly facing surface of the second panel when the second panel and the third panel are in their initial positions, is thereby exposed and so also advantageously provides an additional surface area on which consumer information may be printed, embossed or otherwise displayed.

The additional surface areas provided by the integral first panel, integral second panel and, where included, integral third panel of the box portion of hinge-lid containers according to the invention may advantageously be accessed by consumers independently of opening and closing of the lid portion and do not interfere with access to smoking articles or other consumer goods housed within the containers.

In addition, as the first panel in the initial position forms at least part of a wall of the box portion, hinged lid containers according to the present invention advantageously have substantially the same external appearance as conventional hinge-lid containers prior to the consumer first opening the first panel by folding it about the first hinge line to the second position. Prior to opening of the first panel by the consumer, the second panel, which in the initial position underlies the first panel and, where included, the third panel, which in the initial position underlies the second panel, are not visible and so do not affect the external appearance of hinge-lid containers according to the invention.

Furthermore, since the second panel is disposed within the box portion in its initial position, behind the wall of the box portion that the first panel forms at least part of in the initial position, the inclusion of this "additional" integral panel in hinge-lid containers according to the present invention does not affect the overall dimensions thereof. Similarly, where included, the third panel is disposed within the box portion in its initial position, behind the second panel, and so also does not affect the overall dimensions of the hinge-lid container.

In preferred embodiments of the present invention, the hinge-lid container comprises a lower box portion and an upper lid portion hinged to the box portion, the lower box portion having a first wall and an opposed second wall that is connected to the first wall by a bottom wall of the box portion, the first panel in the initial position forming at least part of the first wall or second wall of the box portion.

In embodiments of the invention, the box portion may comprise a front wall, an opposed rear wall, a pair of opposed side walls and a bottom wall that define a receptacle for consumer goods, the first panel forming at least part of the front wall, the rear wall or one of the side walls of the box portion in the initial position and the second panel underlying the first panel within the receptacle in the initial position.

Preferably, the first panel in the initial position forms at least part of a main or major wall of the box portion. Preferably, the first panel in the initial position forms at least part of a front wall or a rear wall of the box portion.

The first panel in the initial position may be defined in the wall of the box portion by one or more lines of weakness including, but not limited to, one or more score lines, one or more creasing lines, one or more lines of perforations or combinations thereof. Preferably, the first panel is defined in the wall of the box portion by at least one score line, creasing line or line of perforations. More preferably, the first panel is defined in the wall of the box portion by at least one score line or line of perforations. Most preferably, the first panel is defined in the wall of the box portion by at least one line of perforations Preferably, the first hinge line is along a longitudinal edge or a transverse edge of the wall of the box portion that the first panel forms at least part of in the initial position. More preferably, the first hinge line is along a longitudinal edge of the wall of the box portion.

Preferably, the first hinge line and the second hinge line are parallel and opposed.

Preferably, the first panel extends across the whole of the wall of the box portion, between opposed edges thereof.

Preferably, a tab extending outwardly from the first panel is provided along an edge of the first panel opposite the first hinge line. In use, a consumer may grasp and pull on the tab in order to fold the first panel about the first hinge line from the initial position to the second position, wherein it is hinged outwardly from the remainder of the container, thereby revealing the underlying second panel.

In a particularly preferred embodiment of the invention, the first panel in the initial position is defined by at least one line of perforations extending across a wall of the box portion substantially perpendicularly to the first hinge line, more preferably by a pair of parallel lines of perforations extending across the wall of the box portion substantially perpendicularly to the first hinge line, and a tab extending outwardly from the first panel is provided along an edge of the first panel opposite the first hinge line. The combination of one or more lines of perforations in the wall of the box portion that define the first panel in the initial position and a protruding tab advantageously allows the first panel of the hinge-lid container according to the invention to be easily first opened by the consumer.

Preferably, a cut-out is provided along an edge of the second panel opposite the second hinge line. In use, the provision of a cut-out facilitates folding of the second panel about the second hinge line from the initial position to the second position by the consumer.

The first panel may be detachably connected to the box portion along the first hinge line. Alternatively, or in addition, the second panel may be detachably connected to the box portion along the second hinge line. For example, the first hinge line may be perforated so that a consumer can remove the first panel from the remainder of the hinge-lid container. In use, by folding the first panel outwardly about the perforated first hinge line from the initial position to the second position and then tearing along the first hinge line, the consumer may detach the first panel from the remainder of the hinge-lid container in order to, for example, retain information provided thereon for future reference or to redeem the first panel as a coupon.

Alternatively, having opened the first panel by folding it outwardly from the initial position to the second position, the consumer may subsequently re-close the first panel by folding it back inwardly about the first hinge line. Preferably, the box portion of the hinge-lid container of the invention further comprises integral retention means for holding the first panel back in re-closed position.

Preferably, the integral retention means comprises at least one tab that in an initial position underlies the first panel. Where the box portion of the hinge-lid container further includes an integral third panel, the integral retention means preferably comprises at least one tab that in an initial position underlies the first panel and overlies the third panel. In use, when re-closing the first panel, the consumer may advantageously insert a portion of the first panel beneath the at least one tab in order to hold the first panel in the re-closed position.

Alternatively the integral retention means may comprise, for example, a tab provided on the first panel and a cooperating slot provided in the box portion of the hinge-lid container, the slot being positioned to accept the tab when the first panel is in the re-closed position.

To increase their surface area and hence the additional surface area to which brand, advertising, promotional, product and other consumer information may be applied, the first panel, the second panel and, where included, the third panel of the box portion of hinge-lid containers according to the invention may each comprise two or more hingedly connected sub-panels that overlie one another in the initial position. Where one or more of the first panel, second panel and, where included, third panel of hinge-lid containers according to the invention comprises two or more hingedly connected sub-panels, the sub-panels may be detachably connected to one another along, for example, perforated fold lines.

In one preferred embodiment of the present invention, the integral first panel in the initial position forms part of the rear wall of the box portion of the hinge-lid cigarette pack or other hinge-lid container. In this embodiment, the first panel in the initial position is preferably defined in a direction parallel to the hinge between the box portion and the lid portion of the container by a pair of spaced apart, parallel lines of perforations that extend across the rear wall of the box portion.

In an alternative preferred embodiment, the first panel in the initial position forms part of the front wall of the box portion of the hinge-lid cigarette pack or other hinge-lid container. In this embodiment, the first panel in the initial position may also be defined in a direction parallel to the hinge between the box portion and the lid portion of the container by a pair of spaced apart, parallel lines of perforations that extend across the front wall of the box portion. Alternatively, the first panel in the initial position may be defined in a direction parallel to the hinge between the box portion and lid portion of the container by a single line of perforations, so that the upper edge of the first panel forms the upper edge of the front wall of the box portion.

To further increase the additional surface areas provided, in yet other preferred embodiments of the present invention the box portion of the hinge-lid container may include two or more integral first panels, each of which in an initial position forms at least part of a different wall of the box portion, and two or more integral second panels, each of which in an initial position underlies a corresponding one of the two or more integral first panels. If desired, in such embodiments the box portion may also further include two or more integral third panels, each of which in an initial position underlies a corresponding one of the two or more integral second panels.

For example, the box portion of a hinge-lid container according to the invention may include an integral first panel that in an initial position forms at least part of a rear wall of the box portion, an integral second panel that in an initial position underlies this first panel and an integral third panel that in an initial position underlies this second panel and another first panel that in an initial position forms at least part of a front wall of the box portion, a further integral second panel that in an initial position underlies this further first panel and an integral third panel that in an initial position underlies this further second panel.

Hinge-lid containers according to the invention may be substantially rectangular parallelepipedal in shape, with right-angled longitudinal and right-angled transverse edges. Alternatively, the box portion, lid portion or both the box portion and the lid portion of hinge-lid containers according to the invention may comprise one or more rounded longitudinal edges, rounded transverse edges, bevelled longitudinal edges, bevelled transverse edges or any combination thereof. For example, by creasing or scoring in a known manner a blank from which the box portion and the lid portion of the hinge-lid container are erected, a "rounded-corner" hinge-lid container according to the invention may be produced.

Hinge-lid containers according to the present invention are particularly advantageously employed as packs for smoking articles such as cigarettes, cigars or cigarillos. Hinge-lid containers according to the present invention may also be advantageously employed as cartons for holding a plurality of individual packs of smoking articles. For example, hinge-lid cartons according to the invention for holding ten individual packs of twenty cigarettes may be produced.

Through an appropriate choice of the dimensions of the blanks from which they are formed, hinge-lid containers according to the invention housing different numbers of regular size, king size, super-king size, slim, super-slim or wide cigarettes may be produced.

As will become apparent from the following description, existing packing machinery for producing conventional hinge-lid cigarette packs may be advantageously used to produce hinge-lid packs of smoking articles according to the present invention, having substantially the same external appearance as such conventional packs, without the need for any or significant machinery modifications, such as, for example, the installation of a conversion kit.

Hinge-lid containers according to the invention may be formed from any suitable material including, but not limited to, for example, cardboard, paperboard, plastic, metallised board, laminated board and combinations thereof. Preferably, hinge-lid containers according to the invention are formed from cardboard.

Preferably, the lid portion and the box portion of hinge-lid containers according to the invention are formed from a one-piece blank, more preferably from a one-piece cardboard blank.

Hinge-lid containers according to the invention may further comprise an inner frame mounted in the box portion at least a portion of which projects from the box portion into space covered by the lid portion in the closed position.

Hinge-lid containers according to the invention may be shrink wrapped or otherwise over wrapped with a transparent polymeric film of, for example, polyethylene or polypropylene in a conventional manner. Where hinge-lid packs containers according to the invention are over wrapped, the over wrapper preferably includes a tear tape that extends around the container parallel to the hinge.

BRIEF DESCRIPTION OF THE DRAWINGS

The invention will be further described, by way of example only, with reference to the accompanying drawings in which.

DETAILED DESCRIPTION

Figure 1:
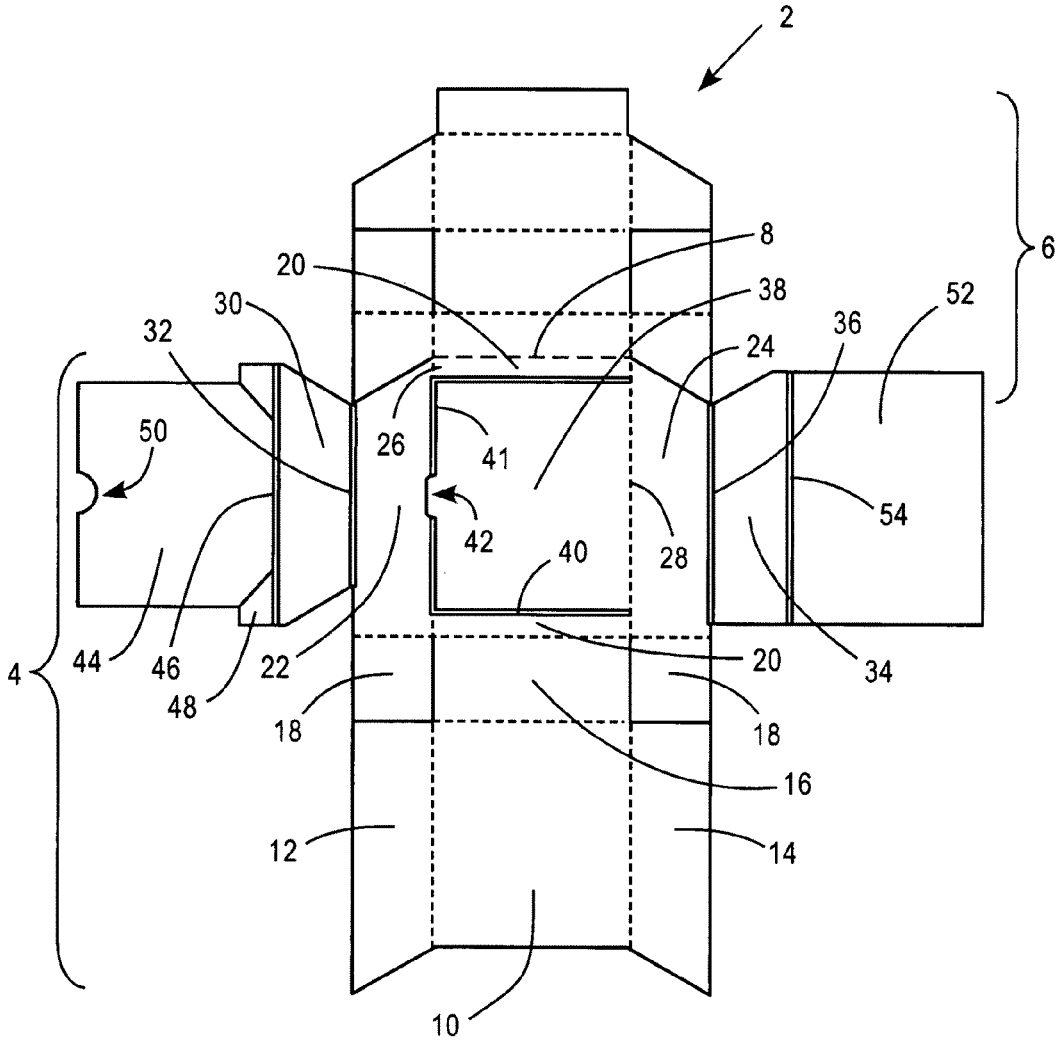
FIG. 1 is a plan view of the front or outer face of a laminar one-piece blank for forming a hinge-lid pack of smoking articles according to a first embodiment of the invention.

The one-piece blanks and hinge-lid pack of smoking articles shown in the figures have several components in common; these have been given the same or similar reference numerals throughout.

The laminar one-piece blank 2 shown in FIG. 1 comprises a box-defining portion 4 and a lid-defining portion 6, which are connected to one another along a transverse hinge line 8 (shown by a bold dashed line in FIG. 1). The box-defining portion 4 and the lid-defining portion 6 include a number of panels and flaps, which when folded about appropriate creasing lines (shown by dashed lines in FIG. 1) and lines of perforations (shown by double lines in FIG. 1) form the box portion and the lid portion of a cuboid hinge-lid pack according to a first embodiment of the invention.

The panels and flaps of the lid-defining portion 6 of the blank 2 of FIG. 1 are of the same construction as those of laminar blanks for forming conventional cuboid hinge-lid cigarette packs and will not be further described.

The box-defining portion 4 of the blank 2 includes a rectangular front wall panel 10, a trapezoidal outer right side wall panel 12 and an opposed trapezoidal outer left side wall panel 14, which are disposed on either side of the front wall panel 10, a rectangular bottom wall panel 16, and a pair of opposed flaps 18, which are disposed on either side of the bottom wall panel 16. These panels and flaps of the box-defining portion 6 of the blank 2 of FIG. 1 are also of the same construction as those of laminar blanks for forming conventional cuboid hinge-lid cigarette packs.

As shown in FIG. 1, the box-defining portion further comprises a rectangular rear wall panel 20, together with a first trapezoidal inner right side wall panel 22 and an opposed, first trapezoidal inner left side wall panel 24, which are disposed on either side of the rear wall panel 20. The first trapezoidal inner right side wall panel 22 and the first trapezoidal inner left side wall panel 24 are foldably connected to the side edges of the rear wall panel 20 along a first longitudinal creasing line 26 and a second longitudinal creasing line 28, respectively.

A second inner right side wall panel 30 is foldably connected along a first longitudinal line of perforations 32 to the side of the first trapezoidal inner right side wall panel 22 opposite the first longitudinal creasing line 26. A second inner left side wall panel 34 is foldably connected along a second longitudinal line of perforations 36 to the side of the first trapezoidal inner left side wall panel 24 opposite the second longitudinal creasing line 28. As shown in FIG. 1, the second inner right side wall panel 30 and the second inner left side wall panel 34 are of reduced height compared to the first trapezoidal inner right side wall panel 22 and the first trapezoidal inner left side wall panel 24.

A rectangular, integral first panel 38 is defined in the rear wall panel 20 of the blank 2 by a pair of parallel, spaced apart, transverse lines of perforations 40 that extend between the first longitudinal creasing line 26 and the second longitudinal creasing line 28 and by a third longitudinal line of perforations 41 that extends along the first longitudinal creasing line 26 between the pair of transverse lines of perforations 40. The first panel 38 is of reduced height compared to the rear wall panel 20 of the box-defining portion 4 of the blank 2 and is hingedly connected to the first trapezoidal inner left side wall panel 24 along the second longitudinal creasing line 28. As shown in FIG. 1, a tab 42 protrudes outwardly from the first panel 38 along the third longitudinal line of perforations 41.

An integral second panel 44 of substantially the same width as the rear wall panel 20 and the first panel 38 is hingedly connected along a fourth longitudinal line of perforations 46 to the side of the second inner right side wall panel 30 opposite the first longitudinal line of perforations 32. As shown in FIG. 1, a pair of trapezoidal retention tabs 48 disposed on either side of the second panel 44 are also hingedly connected to the second inner right side wall panel 30 along the fourth longitudinal line of perforations 46, at opposite ends thereof. A central, hemispherical cut-out 50 is provided along the edge of the second panel 44 opposite the fourth longitudinal line of perforations 46.

A rectangular, integral third panel 52 of substantially the same height as the second trapezoidal inner left side wall panel 34 is hingedly connected along a fifth longitudinal line of perforations 54 to the side of the second inner left side wall panel 34 opposite the second longitudinal line of perforations 36.

To erect a hinge-lid pack of smoking articles from the blank 2 shown in FIG. 1, the second inner right side wall panel 30 is first folded through 180 degrees about the first longitudinal line of perforations 32, so that it underlies the first trapezoidal inner right side wall panel 22 and the pair of retention tabs 48 and the second panel 44 underlie the first panel 38 in the rear wall 20 of the box-defining portion 4 of the blank 2. The second inner right side wall panel 30 is affixed to the first trapezoidal inner right side wall panel 22 by, for example, adhesive.

The second inner left side wall panel 34 is then folded through 180 degrees about the second longitudinal line of perforations 36 so that it underlies the first trapezoidal inner left side wall panel 24 and the third panel 52 underlies the second panel 44 and the pair of retention tabs 48. The second inner left side wall panel 34 is also affixed to the first trapezoidal inner left side wall panel 24 by, for example, adhesive.

Figure 2:
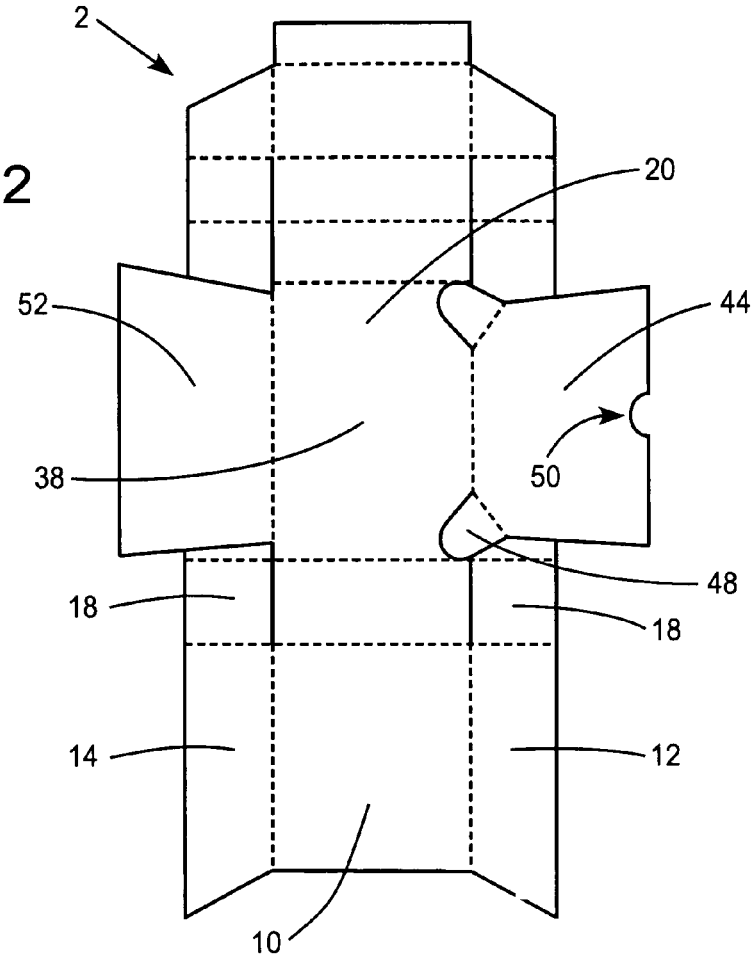
FIG. 2 shows a photograph of the back or inner face of a partially folded blank of the type shown in FIG. 1.

A photograph of the back or inner face of a blank 2 of the type shown in FIG. 1 with the second inner right side wall panel 30 and the second inner left side wall panel 34 folded through 180 degrees and affixed to the first trapezoidal inner right side wall panel 22 and the first trapezoidal inner left side wall panel 24, respectively, is shown in FIG. 2. To illustrate the relative positions of the first panel 38, second panel 44, retention tabs 48 and third panel 52 in the partially folded blank 2, in FIG. 2 the third panel 52 and the second panel 44 are shown folded outwardly about the fifth longitudinal line of perforations 54 and the fourth longitudinal line of perforations 46, respectively.

The folding of the second inner right side wall panel 30 and the second inner left side wall panel 34 is carried out offline. To complete erection of the hinge-lid pack of smoking articles, the partially folded blank 2 is then delivered to existing cigarette packing machinery to be folded around a prewrapped bundle of smoking articles and, if desired, inner frame, in a conventional manner. The footprint of the partially folded blank 2 is the same as that of existing laminar blanks for forming conventional hinge-lid cigarette packs. Consequently, erection of a hinge-lid pack from the partially folded blank 2 advantageously requires no modification to the existing packing machinery or only very minor modifications to the existing packing machinery, for example, to the feeder thereof.

In use, the consumer grasps and pulls on the protruding tab 42 to open the first panel 38. Pulling on the tab 42 separates the first panel 38 from the remainder of the rear wall 20 of the box portion 4 along the lines of perforations 40, 41 and folds the first panel 38 outwardly from the hinge-lid pack about the second longitudinal creasing line 28, which acts as a first hinge line, to the position shown in FIG. 3. The second panel 44 and the pair of retention tabs 48 underlying the first panel 38 are thereby exposed.

Figure 3:
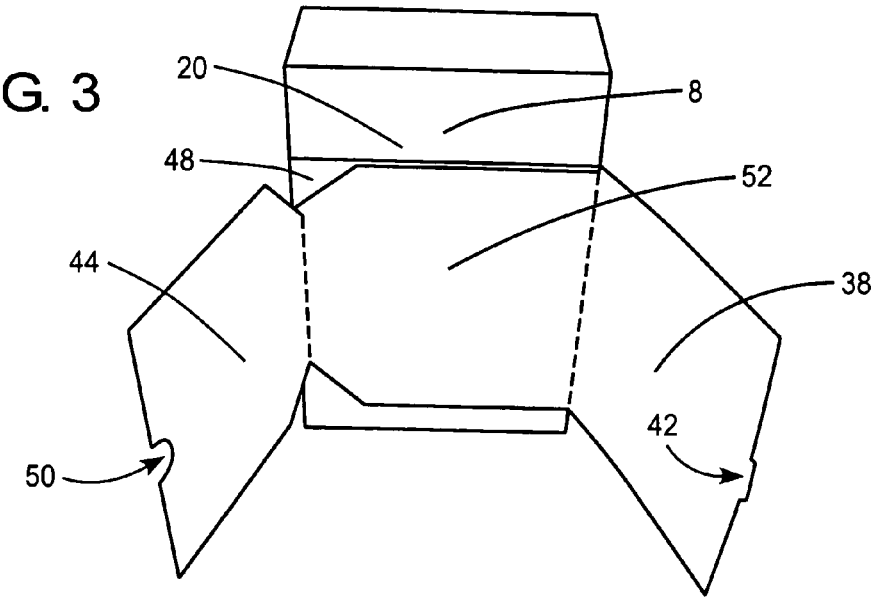
FIG. 3 shows a rear elevation of a hinge-lid pack of smoking articles according to a first embodiment of the invention formed from the blank of FIG. 1 with the first panel and the second panel in the second position.

To open the second panel 44, the consumer then grasps the second panel 44 using the cut-out 50 and folds it outwardly from the hinge-lid pack about the fourth longitudinal line of perforations 46, which acts as a second hinge line, through the aperture in the rear wall 20 of the box portion 4 of the hinge-lid pack left by the opened first panel 38. As shown in FIG. 3, this exposes the third panel 52, underlying the second panel 44.

Once the consumer has, for example, finished reading product or other information printed, embossed or otherwise displayed on the outer surface of the third panel, inner and outer surfaces of the second panel 44 and inner surface of the first panel, they re-close the second panel 44 by folding it back inwardly about the fourth longitudinal line of perforations 46. The consumer then re-closes the first panel 38 by folding it back inwardly about the second longitudinal creasing line 28 and inserts opposed corner portions of the first panel underneath the pair of retention tabs 48 in order to retain the first panel 38 in the re-closed position.

Instead of re-closing the second panel 44 and the first panel 38, the consumer may alternatively detach one or both of them from the remainder of the box portion 4 of the hinge-lid pack along the fourth longitudinal line of perforations 46 and the second longitudinal creasing line 28, respectively. To facilitate detachment of the first panel 38 for use as, for example, coupons, the second longitudinal creasing line 28 may also be perforated.

It will be appreciated that, if desired, one or more of the creasing lines of the blank 2 for forming the hinge-lid pack according to the first embodiment of the invention may be replaced by a scoring line. It will also be appreciated that one or more of the first longitudinal line of perforations 32, the second longitudinal line of perforations 36, the fourth longitudinal line of perforations 46 and the fifth longitudinal line of perforations may be replaced by a creasing line or scoring line.

Figure 4:
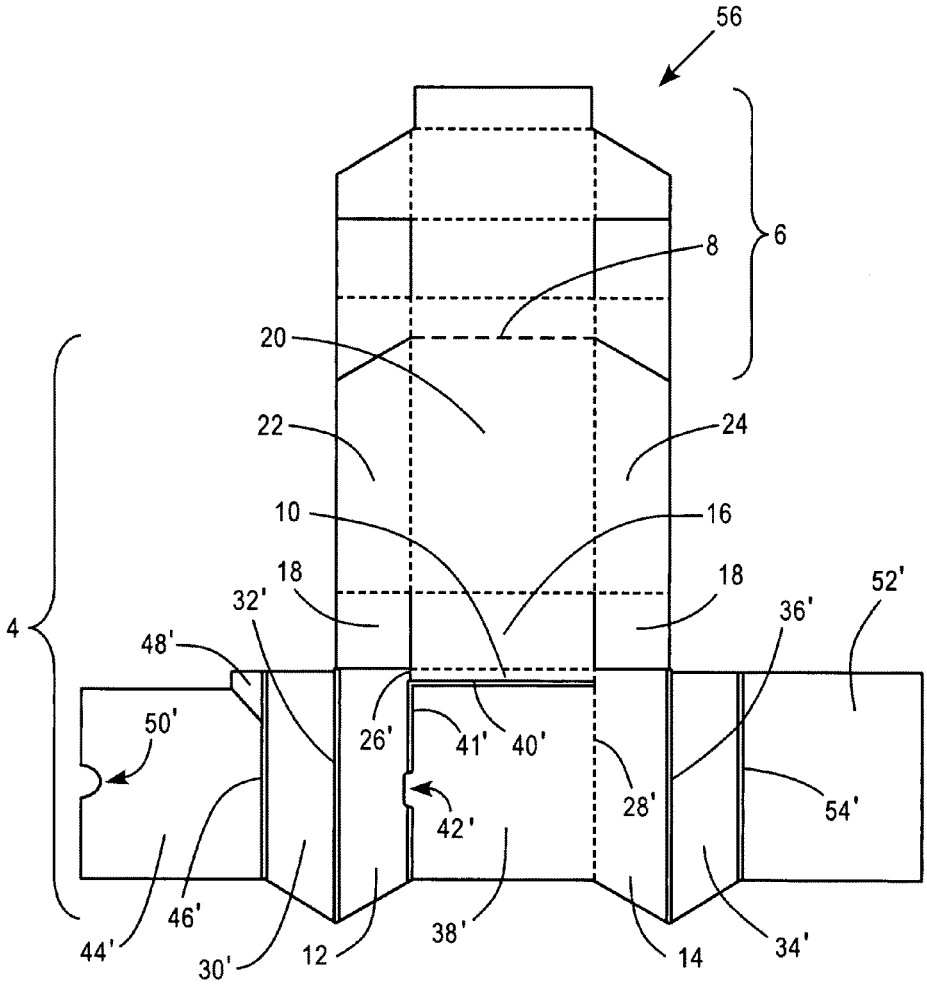
FIG. 4 is a plan view of the front face of a laminar one-piece blank for forming a hinge-lid pack of smoking articles according to a second embodiment of the invention.
Figure 5:
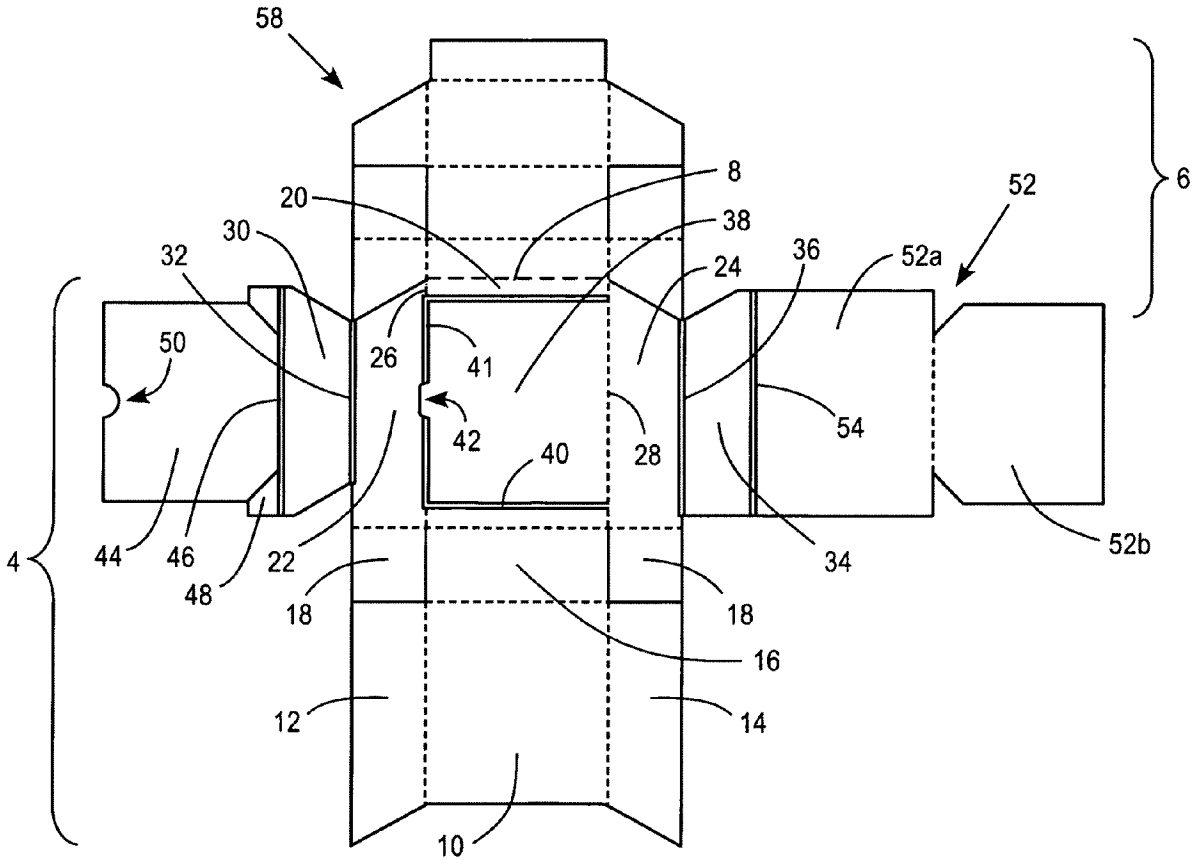
FIG. 5 is a plan view of the front face of a laminar one-piece blank for forming a hinge-lid pack of smoking articles according to a third embodiment of the invention.
Figure 6:
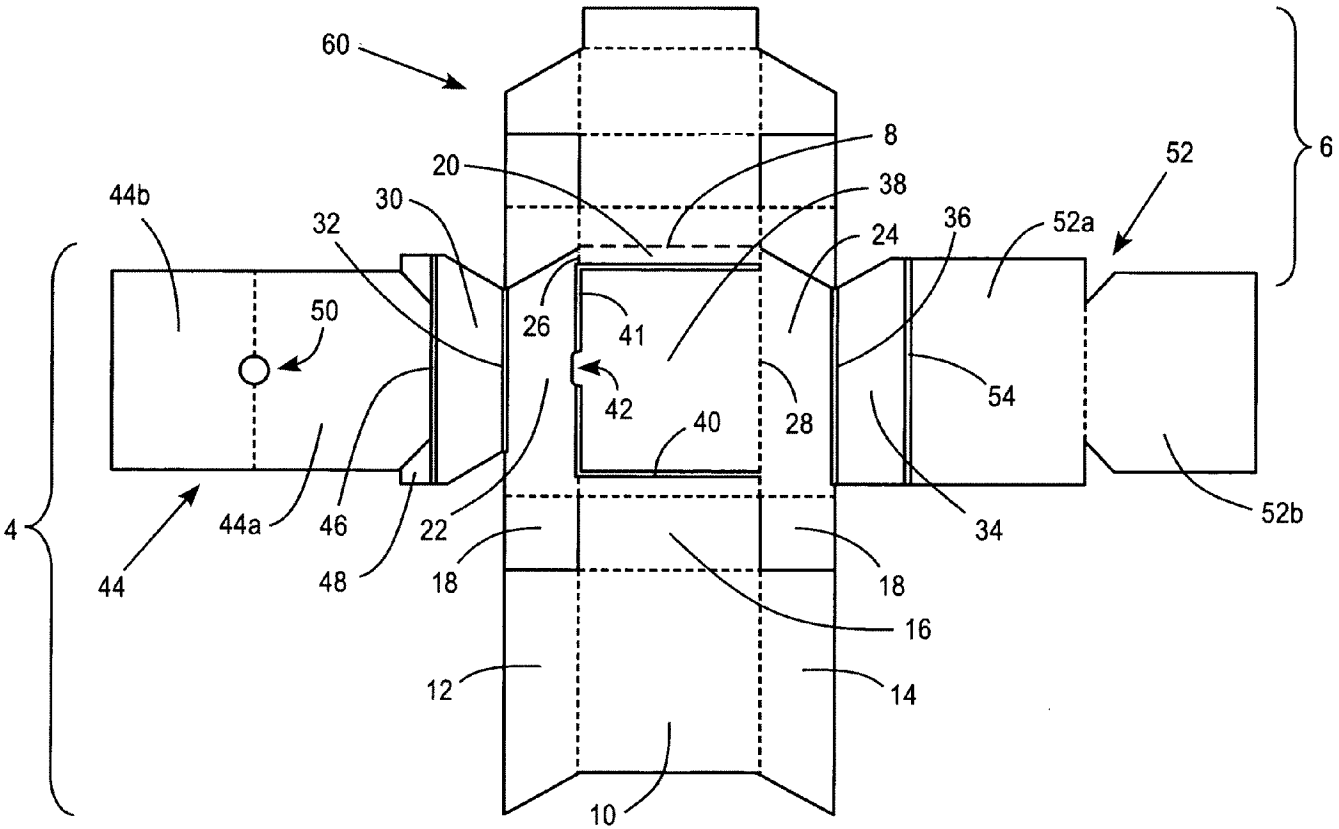
FIG. 6 is a plan view of the front face of a laminar one-piece blank for forming a hinge-lid pack of smoking articles according to a fourth embodiment of the invention.
Figure 7:
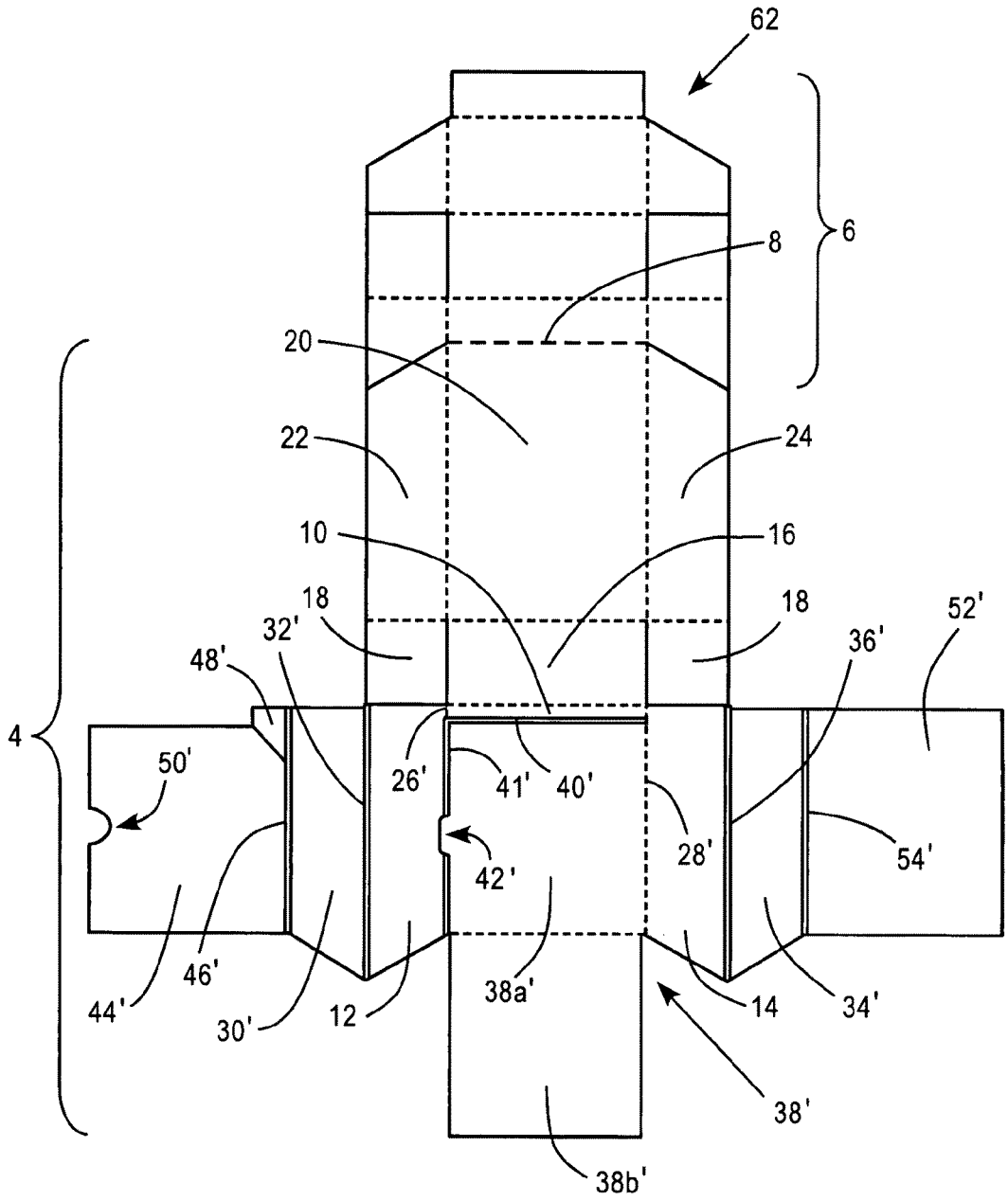
FIG. 7 is a plan view of the front face of a laminar one-piece blank for forming a hinge-lid pack of smoking articles according to a fifth embodiment of the invention.

A plan view of the front face of a laminar one-piece blank 56 for forming a hinge-lid pack of smoking articles according to a second embodiment of the invention is shown in FIG. 4. In the second embodiment of the invention, the first panel 38' is defined in the front wall 10 of the box portion 4 of the hinge-lid pack of smoking articles, rather than in the rear wall 20 thereof.

As shown in FIG. 4, in the blank 56 for forming a hinge-lid pack of smoking articles according to the second embodiment of the invention the integral second panel 44' is foldably connected along the fourth longitudinal line of perforations 46' to a second outer right side wall panel 30' that is foldably connected along the first longitudinal line of perforations 32' to the right outer side wall panel 12 of the box-defining portion 4 of the blank 56. Similarly, the third panel 52' of the blank 56 is foldably connected along the fifth longitudinal line of perforations 54 to a second outer left side wall panel 34' that is foldably connected along the second longitudinal creasing line 28 to the left outer side wall panel 14 of the box-defining portion 4 of the blank 56. In addition, the blank 56 only comprises a single retention tab 48', which is hingedly connected to the second outer right side wall panel 30' along the fourth longitudinal line of perforations 46'. The blank 56 shown in FIG. 4 further differs from the blank 2 shown in FIG. 1 in that only a single transverse line of perforations 40' is provided in the front wall 10 of the box-defining portion 4 of the blank 56 to define the first panel 38'. It will be appreciated, however, that the first panel 38' in the front wall 10 of the blank 56 could alternatively be defined by a pair of parallel, spaced apart, transverse lines of perforations 40' extending between the first longitudinal creasing line 26' and the second longitudinal creasing line 28'.

In order to erect a hinge-lid pack of smoking articles according to the second embodiment, the blank 56 is folded in an analogous manner to that previously described for the blank 2 of FIG. 1. In use, information displayed on the additional surface areas provided by the outer surface of the third panel 52', the inner and outer surfaces of the second panel 44' and the inner surface of the first panel 38' of the erected hinge-lid pack is accessed by the consumer in an identical manner to that previously described.

FIGS. 5 to 9 show plan views of the front faces of laminar one-piece blanks 58, 60, 62, 64, 66 for forming hinge-lid packs of smoking articles according to third, fourth, fifth, sixth and seventh embodiments of the invention, respectively. Each of the blanks shown in FIGS. 5 to 9 comprises a box-defining portion 4 and a lid-defining portion 6, which are connected to one another along a transverse hinge line 8. The panels and flaps of the lid-defining portion 6 of the blanks are once again of the same construction as those of laminar blanks for forming conventional cuboid hinge-lid cigarette packs.

To increase the surface area thereof, and hence the additional surface areas to which brand, advertising, promotional, product and other consumer information may be applied, at least one of the first panel, the second panel and the third panel of each of the blanks shown in FIGS. 5 to 9 comprises two sub-panels, labelled with the reference "a" and "b" in the Figures, that are foldably connected to one another along a creasing line.

During erection of hinge-lid packs according to third, fourth, fifth, sixth embodiment of the invention from the blanks, the two sub-panels forming the first panel, the second panel and/or the third panel are folded so that they overlie one another, before the blanks are subsequently folded in the manner previously described for the blank 2 shown in FIG. 1. It will be appreciated that hinge-lid containers according to the invention having first panels, second panels and/or third panels comprising three or more foldably connected sub-panels, which are initially folded in a concertina or accordion fashion so as to overlie one another, could also be similarly produced.

Figure 8:
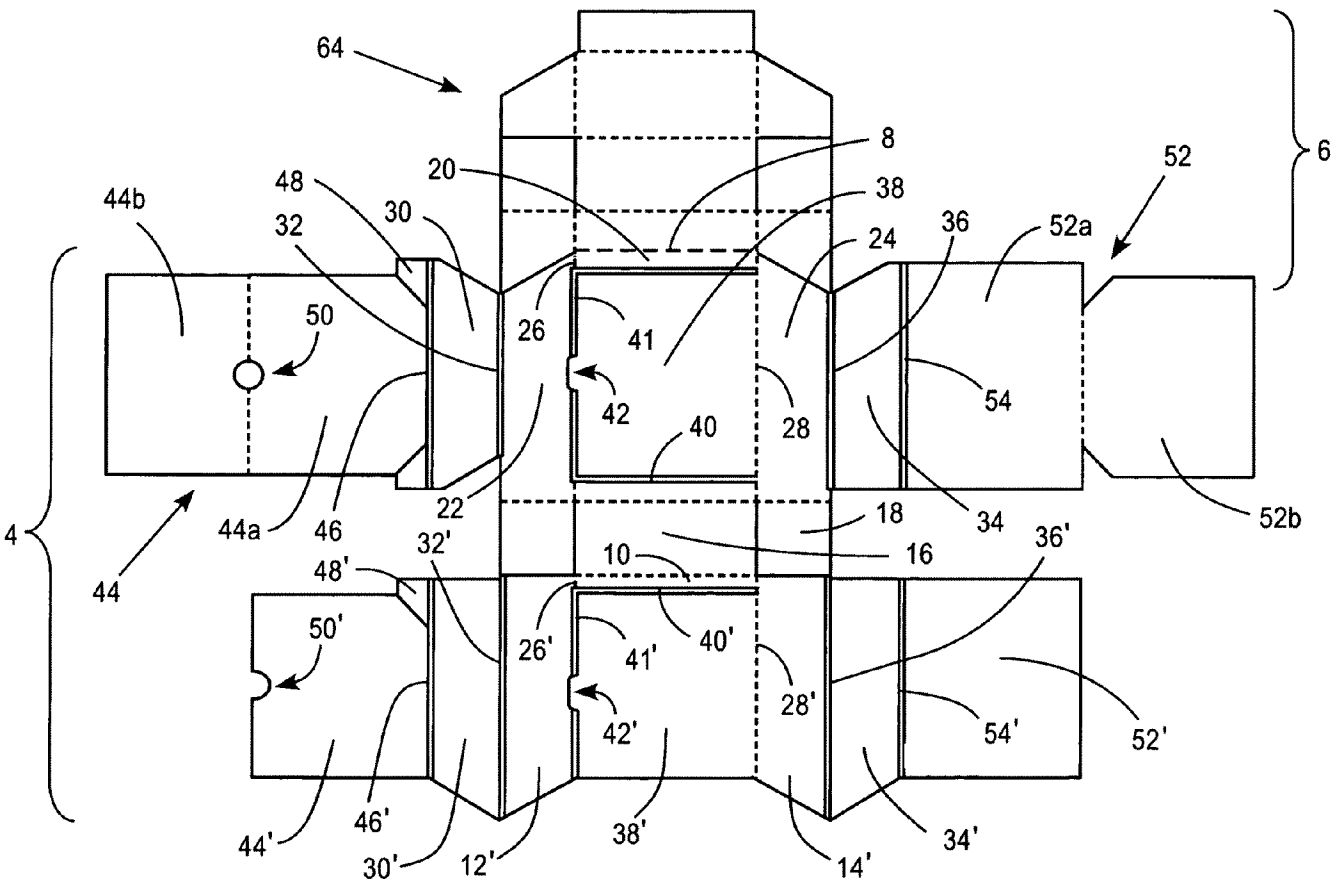
FIG. 8 is a plan view of the front face of a laminar one-piece blank for forming a hinge-lid pack of smoking articles according to a sixth embodiment of the invention.
Figure 9:
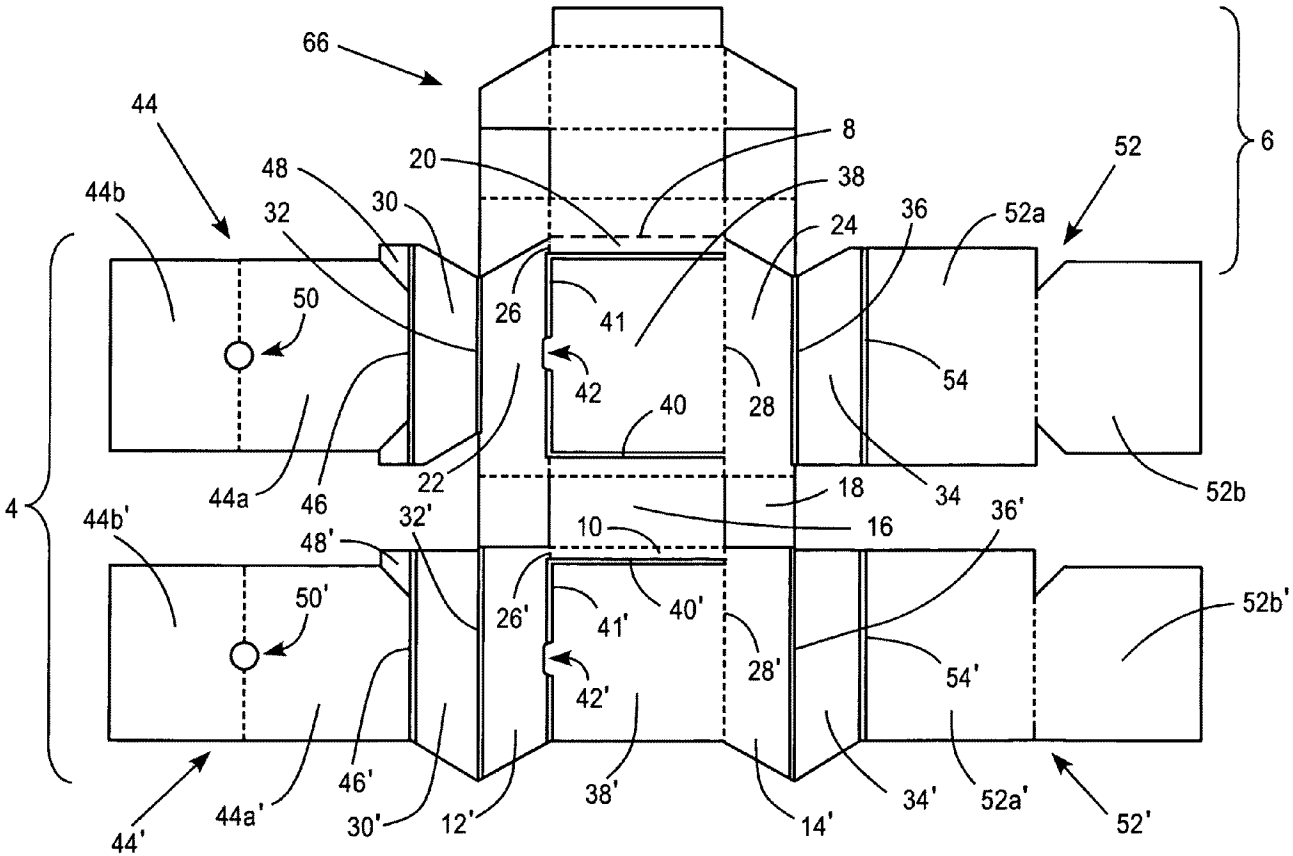
FIG. 9 is a plan view of the front face of a laminar one-piece blank for forming a hinge-lid pack of smoking articles according to a seventh embodiment of the invention.

To further increase the additional surface area provided by the hinge-lid packs according to the fifth and sixth embodiments of the invention, the blank 64 and the blank 66 shown in FIGS. 8 and 9, respectively, not only have a first panel 38 defined in the rear wall 20 of the box-defining portion 4 thereof, but also a further first panel 38' defined in the front wall 10 of the box-defining portion 4 thereof. The construction of these blanks is, therefore, based on a combination of the construction of the blank 2 shown in FIG. 1 and the construction of the blank 56 shown in FIG. 4.

The hinge-lid packs according to the first to seventh embodiments of the invention, formed from the blanks 58, 60, 62, 64, 66 shown in FIGS. 1 and 4 to 9, respectively, comprise three integral panels: a first panel, which in an initial position forms part of a wall of the box portion of the pack; a second panel, which in an initial position underlies the first panel; and a third panel, which in an initial position underlies the second panel.

Figure 10:
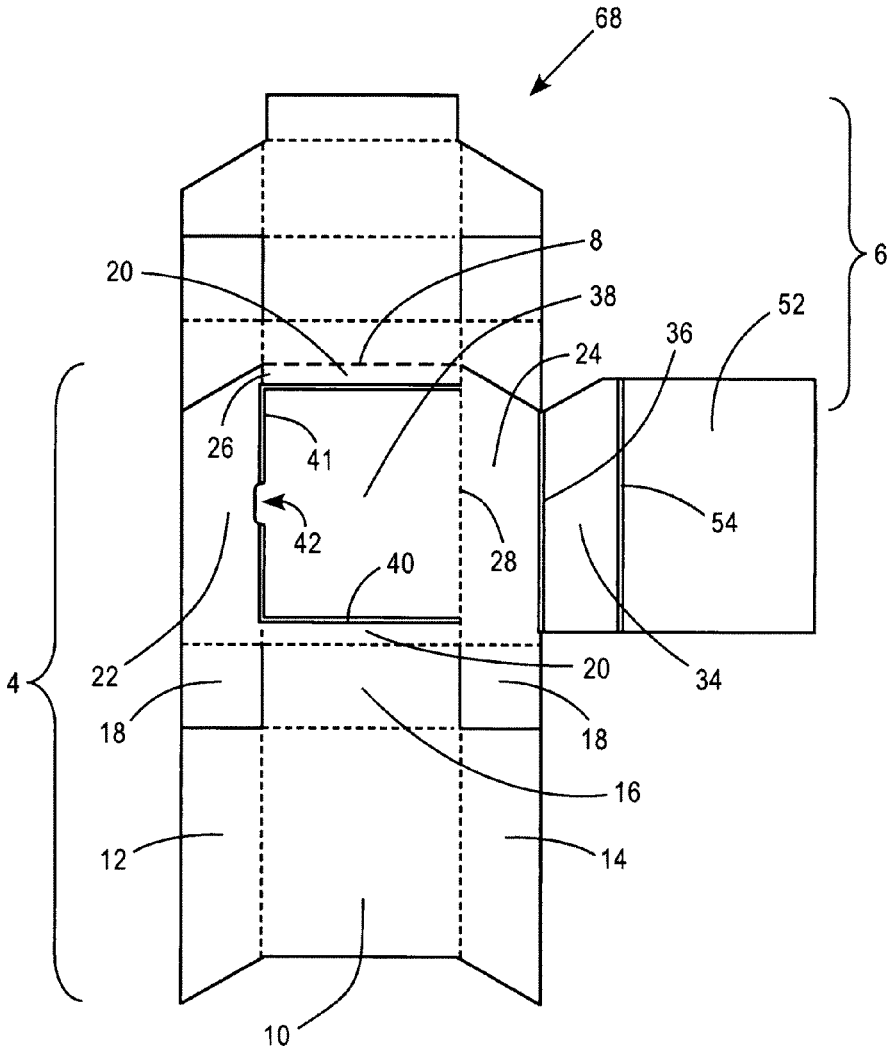
FIG. 10 is a plan view of the front face of a laminar one-piece blank for forming a hinge-lid pack of smoking articles according to a eighth embodiment of the invention.

It will be appreciated, however, that hinge-lid containers according to the invention comprising two integral panels, a first panel, which in an initial position forms part of a wall of the box portion of the container, and a second panel, which in an initial position underlies the first panel, may also be produced. For example, FIG. 10 shows a plan view of the front face of a laminar one-piece blank 68 for forming a hinge-lid pack of smoking articles according to an eighth embodiment of the invention. In the eighth embodiment of the invention, the first panel 38 is defined in the front wall 10 of the box portion 4 of the hinge-lid pack of smoking articles, as in the hinge-lid pack according to the first embodiment of the invention previously described above. However, in the eighth embodiment, the third panel 52 directly underlies the first panel 38 in an initial position, the second panel 44 being omitted.

As shown in FIG. 10, the blank 68 for forming a hinge-lid pack of smoking articles according to the eighth embodiment of the invention does not include an integral second panel 44, a second inner right side wall panel 30 or a first longitudinal line of perforations 32, but is otherwise identical in construction to the blank 2 shown in FIG. 1.

Hinge-lid packs of smoking articles according to the invention formed from the laminar blanks shown in FIG. 1 and FIGS. 4 to 10 may be shrink wrapped or otherwise over wrapped with a transparent polymeric film of, for example, polyethylene or polypropylene in a conventional manner.

From the foregoing description, it will be appreciated that hinge-lid containers according to the present invention advantageously enable additional information to be provided to consumers for reading and, in certain embodiments, removal in a manner that does not interfere with the consumers' access to smoking articles or other products housed in the container.

Furthermore, it will be appreciated that hinge-lid packs of smoking articles according to the present invention may be advantageously produced using existing packing machinery following only minor modifications thereto and without any change to existing cigarette or conventional hinge-lid pack dimensions.

The invention claimed is:

1. A hinge-lid container comprising:

a box portion; and a lid portion hinged to the box portion, the box portion including:

an integral first panel connected to a remainder of the container along a first hinge line;

an integral second panel connected to the remainder of the container along a second hinge line; and an integral third panel having an outwardly facing surface, the third panel in an initial position underlying the second panel so that the third panel lies flat against the second panel in the initial position and connected to the remainder of the container along a third hinge line, the first panel in an initial position forming at least part of a wall of the box portion and the second panel in an initial position underlying the first panel, the first panel being defined in the wall of the box portion by at least one line of weakness in the initial position and being foldable about the first hinge line from the initial position to a second position in which it is hinged outwardly from the remainder of the container, wherein the first panel is foldable about the first hinge line from the second position back to the initial position and the box portion further includes integral retention tabs disposed on either side of the second panel for holding the first panel back in the initial position.

2. A hinge-lid container according to claim 1 wherein the first panel is defined in the wall of the box portion by at least one score line, creasing line or line of perforations.

3. A hinge-lid container according to claim 1 wherein the first panel is defined in the wall of the box portion by at least one line of perforations.

4. A hinge-lid container according to claim 1 wherein a tab extending outwardly from the first panel is provided along an edge of the first panel opposite the first hinge line.

5. A hinge-lid container according to claim 1 wherein the first panel comprises two or more hingedly connected sub-panels.

6. A hinge-lid container according to claim 1 wherein the first panel is detachably connected to the remainder of the container along the first hinge line.

7. A hinge-lid container according to claim 1 wherein the second panel is foldable about the second hinge line from the initial position to a second position in which it is hinged outwardly from the remainder of the container.

8. A hinge-lid container according to claim 1 wherein a cut-out is provided along an edge of the second panel opposite the second hinge line.

9. A hinge-lid container according to claim 1 wherein the second panel comprises two or more hingedly connected sub-panels.

10. A hinge-lid container according to claim 1 wherein the second panel is detachably connected to the remainder of the container along the second hinge line.

11. A hinge-lid container according to claim 1 wherein the third panel comprises two or more hingedly connected sub-panels.

12. A hinge-lid container according to claim 1 wherein the integral retention tabs underlie the first panel in the initial position.

13. A hinge-lid container according to claim 1 wherein the first panel is defined in a rear wall of the box portion.

14. A hinge-lid container according to claim 1 wherein the first panel is defined in a front wall of the box portion.

15. A hinge-lid container according to claim 1 wherein the box portion and the lid portion are formed from a one-piece blank.

16. A blank for forming the box portion and the lid portion of a hinge-lid container according to claim 1.

17. A hinge-lid container comprising:

a box portion; and a lid portion hinged to the box portion, the box portion including:

an integral first panel connected to a remainder of the container along a first hinge line;

an integral second panel connected to the remainder of the container along a second hinge line; and an integral third panel having an outwardly facing surface, the third panel in an initial position underlying the second panel so that the third panel lies flat against the second panel in the initial position and connected to the remainder of the container along a third hinge line, the first panel in an initial position forming at least part of a wall of the box portion and the second panel in an initial position underlying the first panel, the first panel being defined in the wall of the box portion by at least one line of weakness in the initial position and being foldable about the first hinge line from the initial position to a second position in which it is hinged outwardly from the remainder of the container, wherein the first panel is foldable about the first hinge line from the second position back to the initial position, the box portion further includes integral retention tabs disposed on either side of the second panel for holding the first panel back in the initial position, the first panel comprises two or more hingedly connected sub-panels, and the second panel comprises two or more hingedly connected sub-panels.

* * * * *